US006098917A

United States Patent [19]

Cruz

[11] Patent Number: 6,098,917

[45] Date of Patent: Aug. 8, 2000

[54] HANDS-FREE PAPER TOWEL DISPENSER

[76] Inventor: Joseph P. Cruz, 9515 Chandon Dr., Orlando, Fla. 32825

[21] Appl. No.: 08/638,454

[22] Filed: Apr. 26, 1996

[51] Int. Cl.[7] ..... B65H 16/10; B65H 16/02; B65H 19/00

[52] U.S. Cl. ..... 242/564.1; 242/590; 312/34.8

[58] Field of Search ..... 242/564, 564.1, 242/564.2, 389, 390.2, 390.8, 590; 312/34.8, 34.19

[56] References Cited

U.S. PATENT DOCUMENTS

| | | | |
|---|---|---|---|
| 2,264,631 | 12/1941 | Fetty | 242/564.1 |
| 3,432,217 | 3/1969 | Cowan | 312/242 |
| 4,108,513 | 8/1978 | Lander | 312/39 |
| 4,771,966 | 9/1988 | Anderson | 242/596 X |
| 4,790,490 | 12/1988 | Chakravorty | 242/564.1 |
| 4,796,825 | 1/1989 | Hawkins | 242/55.53 |
| 4,826,262 | 5/1989 | Hartman | 83/208 |
| 4,960,248 | 10/1990 | Bauer et al. | 242/564.4 |
| 4,979,688 | 12/1990 | Tinker et al. | 242/564 X |
| 5,125,623 | 6/1992 | Kiedinger | 251/295 |
| 5,199,119 | 4/1993 | Weber | 4/619 |
| 5,329,672 | 7/1994 | Froehlich | 24/67.9 |
| 5,361,812 | 11/1994 | Arneson et al. | 141/275 |
| 5,398,931 | 3/1995 | Tohgoh | 271/126 |
| 5,409,181 | 4/1995 | Patrick | 242/596.2 |
| 5,417,261 | 5/1995 | Kanzler et al. | 141/313 |
| 5,511,763 | 4/1996 | Green | 251/129.02 |
| 5,772,291 | 6/1998 | Byrd et al. | 312/34.22 |

*Primary Examiner*—John Q. Nguyen
*Attorney, Agent, or Firm*—Dorothy S. Morse

[57] ABSTRACT

A paper towel dispense, and a method for its use, comprising a foot pedal for hands-free rotation of a paper towel roll so that individual portions of toweling thereon are made available one at a time to a person activating the dispenser by depressing the foot pedal. The operator would only be required to use his or her hands to touch a portion of the clean paper towel offered through the housing and pull on it so as to separate the offered toweling from the remainder of the continuous length of toweling on the roll. It is contemplated for application to include products other than paper toweling which are dispensed from a roll. It is contemplated for paper towels to be dispensed in response to either a mechanical foot pedal or a foot operated electrical control circuit.

8 Claims, 2 Drawing Sheets

HANDS-FREE PAPER TOWEL DISPENSER

BACKGROUND—FIELD OF INVENTION

This invention relates to dispensers for products which have a continuous length and are stored on a roll, specifically to a paper towel dispenser having remote means including a foot pedal for causing rotation of the paper towel roll so that separable towels thereon, or portions of a continuous roll of toweling which may be torn from the toweling remaining on the roll into assorted lengths, are offered one at a time to a person needing a towel without a need for the person's hands to contact anything but the portion of clean toweling dispensed through the housing. It is contemplated, for application to include; but not be limited to, the dispensing of paper towels from a roll in public rest rooms, rest rooms in restaurants, hospitals, office buildings, and other facilities wherein it is desirable for people who have washed their hands to thereafter expose them to a minimum of post-washing contamination.

BACKGROUND—DESCRIPTION OF PRIOR ART

Commercial establishments and public rest rooms are known to provide a variety of means for drying a person's hands after washing, to include electrical dryers, dispensers having cloth toweling on a roll, paper towel dispensers which hold a stack of folded paper towels, and paper towel dispensers holding a roll of paper toweling which have hand operated cranks or depressible levers for use in the dispensing of towels. Each of these drying means has at least one disadvantage.

The electric dryers are expensive to install and use. Further, they require an operator to use his or her hand to press a button for activation. Many people with freshly washed hands do not want to touch any object in a public bathroom, including a dryer activation button, which may deposit other peoples' germs onto their clean hands, or another portion of their upper body such as an arm or an elbow if such upper body portion is alternatively used to activated the dryer. Also, many people will not take the time to use electric dryers when they are provided, as it takes several moments of hand rubbing beneath the expelled hot air to evaporate excess moisture from one's hands. As a result, when electric dryers are the only hand drying means available in a rest room, people choosing not to use them will shake excess water onto the floor, walls, and door of the rest room creating potentially hazardous and unsanitary conditions therein.

Although not in common use today, dispensers having cloth toweling on a roll have been used in place of paper towel dispensers to eliminate problems associated with loose paper towels being thrown and dropped on public rest room floors. In such toweling dispensers a loop of cloth toweling is exposed at all times through the housing for use and a fresh portion of the cloth toweling is offered to an operator each time the operator exerts a downward force on the upper side portions of the toweling loop exposed through the dispenser housing. The length of the loop remains constant during use, as a portion of the used toweling is also returned to the dispenser housing each time the operating mechanism is activated. However, cloth toweling dispensers have the drawback of being more expensive to use than paper towel dispensers. Also, cloth toweling dispensers can sometimes be hard to use. Many times it takes several pulls on the edges of the exposed, used portion of the toweling for the dispenser to release a clean portion of toweling for use. Also, cloth toweling dispensers tend to jam, leaving the person needing a towel with only a portion of used toweling exposed for use.

Folded paper towel dispensers are in common use and hold a stack of folded towels which are available through an opening in the bottom of the dispenser. One disadvantage of folded paper towel dispensers is that when they are newly filled it is often too difficult to pull an entire towel out of the dispenser's bottom opening. Instead, a person attempting to obtain a towel often is left with only a small piece of a towel in his or her hands after pulling on the exposed portion of the bottom towel. Also, another disadvantage of this type of dispenser is that when folded paper towel dispensers are nearly empty, more than one towel is often unexpectedly released from the dispenser when a person tries to access a single towel, the surplus towels being dropped on the floor, discarded, or otherwise wasted.

The disadvantage of using paper towel dispensers having a hand-operated crank or depressible lever for dispensing paper towels on a roll is that a person with freshly washed hands is required to touch the crank or depressible lever, which may or may not be clean, in order to obtain a towel from the dispenser. Having to touch a dirty crank or depressible lever defeats the original purpose of washing one's hands. It is not known to have a means for drying a person's hands which has a foot-operated pedal that is quick to use, does not jam like the cloth towel dispensers and fully filled folded paper towel dispensers, does not involve the problems associated with nearly empty folded paper towel dispensers which may unexpectedly release more than one towel, and does not require touching of a potentially dirty hand-operated button, crank, or depressible lever. The present invention, with its foot pedal-operated hand-free dispensing of paper towels on a roll, overcomes all of these disadvantages of known paper towel holders.

It is generally known to have foot-pedals for accomplishing hands-free tasks. Foot pedals are known to be used for the hands-free dispensing of water and the opening of doors to surgical facilities in hospitals. Also, in industrial applications foot pedals activate the dispensing of both liquids and pulverized materials. However, it is not known to apply foot pedals, to solve the age-old problem of washing one's hands in a public rest room to clean them, and then having to touch something of questionable cleanliness, such as a hands-operated button, a lever, or a crank, to obtain means for drying one's hands.

SUMMARY OF INVENTION—OBJECTS AND ADVANTAGES

It is the primary object of this invention to provide a dispenser for paper towels on a roll which allows hands-free dispensing of paper towels. It is also an object of this invention to provide a dispenser for paper toweling on a roll which allows quick and easy access to the paper toweling stored within. A further object of this invention is to provide a dispenser for paper towels on a roll which does not jam and thereby prevent the successful dispensing of paper towels. It is also an object of this invention to provide a dispenser for paper towels on a roll which does not suddenly and unexpectedly release more than one portion of toweling at a time. A further object of this invention is to provide a dispenser for products other than paper towels which are stored on a roll. It is also an object of this invention to provide a dispenser for products stored on a roll which may be used with products stored as separable sheets on the roll, as well as products stored as one continuous sheet on a roll which can be torn into a variety of assorted lengths for use.

As described herein, properly manufactured and used, the present invention would provide a paper towel dispenser which would allow a person hands-free dispensing of paper towels. In one embodiment, a foot pedal may be used to activate a control circuit to engage a motor that rotates the paper towel roll for offering one paper towel at a time through the housing for use. In the alternative, the foot pedal may be mechanically connected to a crank for rotation of the paper towel roll. Since a drive gear is used in combination with a pinion gear or a ratchet, the dispenser does not jam, and also will not unexpectedly release excess toweling. The depressing of a foot pedal, whether for activation of a control circuit or for mechanical engagement of a crank, offers quick and easy dispensing of a portion of a continuous length of product from a roll. It is not contemplated for the present invention to be limited to the dispensing of paper towels. In addition, power for operating the motor may be supplied by either alternating current or direct current means.

The description herein provides preferred embodiments of the present invention but should not be construed as limiting the scope of the hands-free paper towel dispensing invention. For example, variations in size and type of motor used, the type of motor mounting bracket used, the configuration of the bracket used to hold the paper towel roll, the configuration of the housing, the positioning of the components within the housing, and the speed with which each paper towel is offered through the housing, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
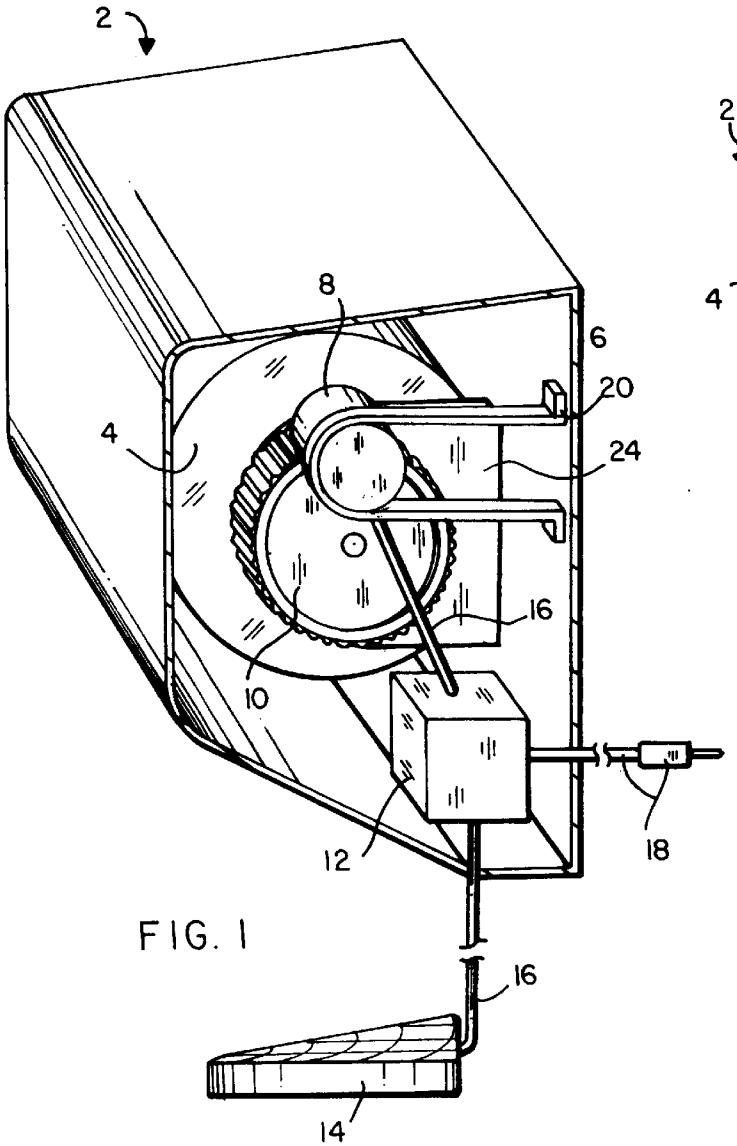
FIG. 1 is a side view of a first embodiment of the invention having connection means to an alternating current power source, a motor driven dispensing means, and a depressible foot pedal for activation of the motor driven means to cause paper towels to be offered one at a time through its housing.

FIG. 1 shows a preferred embodiment of the present invention as a paper towel dispensing invention 2 having a paper towel roll 4 positioned within a hollow housing 6. It is not critical to paper towel dispensing invention 2 whether paper towels stored on paper towel roll 4 are separable into uniformly sized sheets or whether paper toweling is stored on paper towel roll 4 as one continuous sheet which may be torn into a variety of assorted lengths for use. One end of a motor bracket 20 is attached to the interior of housing 6. A motor 8 is attached to, and supported by, the other end of motor bracket 20. FIG. 1 also shows motor 8 positioned to engage, or cause rotation of, a drive gear 10 which is positioned adjacent to one end of paper towel roll 4. In addition, FIG. 1 shows an electrical cord 16 connected through a control circuit 12 and further extending beyond control circuit 12 for attachment to a foot pedal 14. An outlet cord and plug 18 connects control circuit 12 to a remote power supply (not shown). Neither the size of motor 8, the type of motor 8 used, the configuration of motor bracket 20, the configuration of housing 6, nor the positioning of motor 8, control circuit 12, and paper towel roll 4 within housing 6 is critical to paper towel dispensing invention 2. In addition, FIG. 1 shows a towel bracket 24 which is attached on one of its ends to the interior surface of housing 6 and which supports paper towel roll 4 for rotation.

Figure 2:
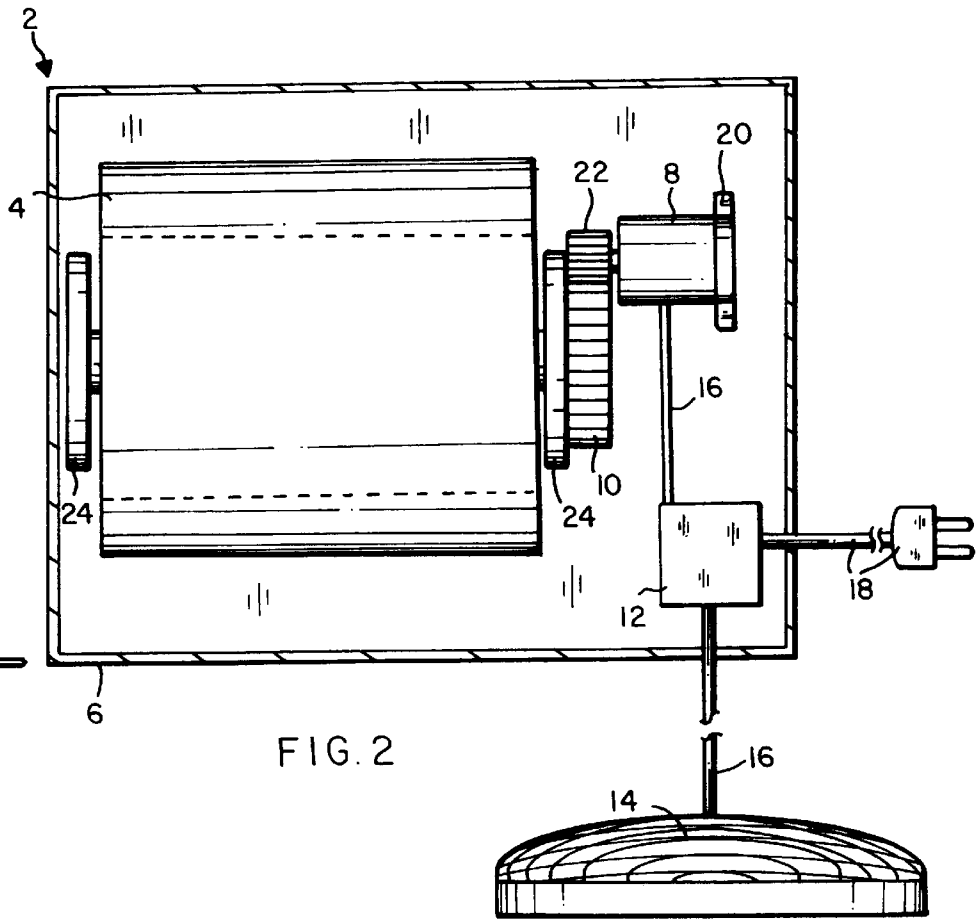
FIG. 2 is a front view of the first embodiment of the invention.

FIG. 2 shows the first embodiment of paper towel dispensing invention 2 having each end of paper towel roll 4 attached to a towel bracket 24 within housing 6. Drive gear 10 is shown positioned adjacent to the portion of the towel bracket 24 which is on the end of paper towel roll 4 facing motor 8. FIG. 2 also shows a pinion gear 22 axially attached to the drive shaft of motor 8, and positioned to cooperatively engage the teeth of drive gear 10. In addition, FIG. 2 shows motor 8 being held against housing 6 by motor bracket 20, electrical cord 16 connected through control circuit 12 and further extending for attachment to foot pedal 14, and outlet cord and plug 18 for connecting control circuit 12 to a remote power supply (not shown). The size and configuration of towel bracket 24 is not critical to paper towel dispensing invention 2 as long as its supports paper roll 4 for easy jam-free rotation.

Figure 3:
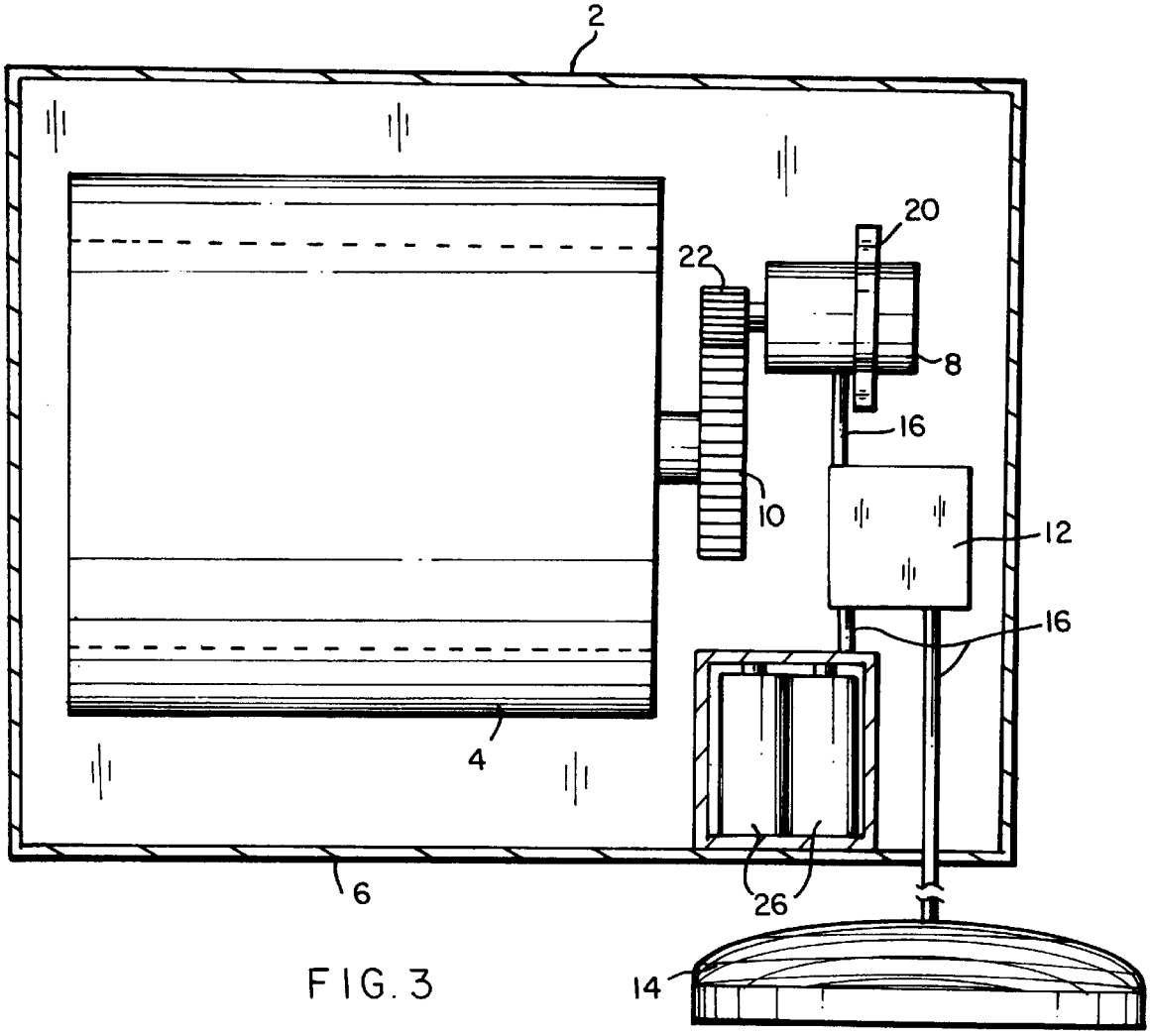
FIG. 3 is a front view of a second embodiment of the invention having a direct current power source and a motor driven dispensing means.

FIG. 3 shows a second embodiment of paper towel dispensing invention 2 having paper towel roll 4 attached to drive gear 10 within housing 6. Pinion gear 22 is cooperatively engaged with drive gear 10 and axially connected to motor 8. FIG. 3 also shows motor 8 attached to housing 6 by motor bracket 20 and motor 8 connected to control circuit 12 by electrical cord 16. Also, connected to control circuit 12 by electrical cords 16 are a direct current power source 26 and foot-pedal 14. It is contemplated for direct current power source 26 to comprise batteries, however, the number, size, and type of batteries used is not critical to paper towel dispensing invention 2.

Figure 4:
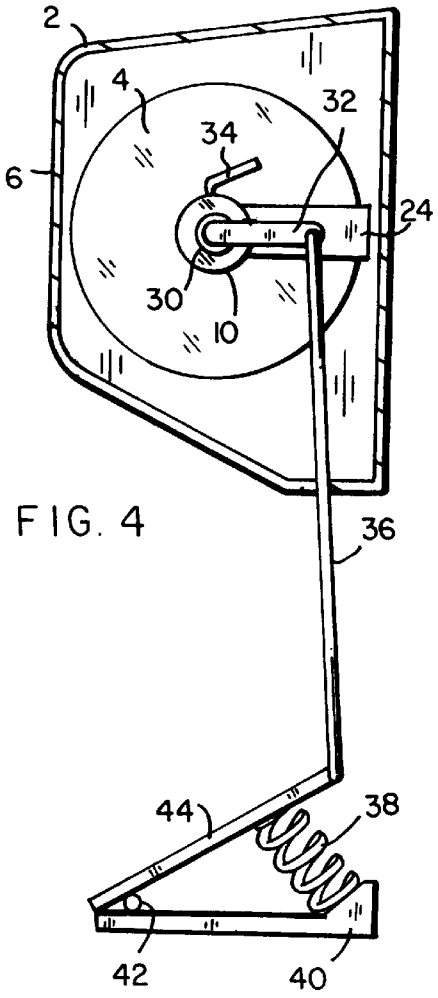
FIG. 4 is a side view of a third embodiment of the invention having a mechanical, spring-biased foot pedal connected to a crank which engages a drive gear to rotate the paper towel roll to cause portions paper of toweling to be offered through its housing for use.

FIG. 4 shows a third embodiment of paper towel dispensing invention 2 having paper towel roll 4 positioned adjacent to drive gear 10 within housing 6. One end of a crank 32 is connected to drive gear 10 and a ratchet 34 is also engaged with the teeth of drive gear 10 so as to allow only one-way rotation of drive gear 10 and paper towel roll 4. Also, ratchet 34 provides limited rotation of drive gear 10 and paper towel roll 4 so that a predetermined amount of toweling is dispensed at one time. The other end of crank 32 is connected to one end of a linkage 36, the other end of linkage 36 being attached to a mechanically operated foot pedal 44 which is connected to a pedal base member 40 by a hinge 42, and mechanically biased from pedal base member 40 by spring means 38.

It is contemplated for housing 6 to be made of a sturdy material which is non-corrosive since it is contemplated for use in a humid rest room environment. Although not shown, it is also contemplated for housing 6 to have a lock thereon to prevent unauthorized tampering with paper towel roll 4. To use paper towel dispensing invention 2, one must either engage foot pedal 14 or mechanically operated foot pedal 44 to cause rotation of paper towel roll 4 so than one portion of paper toweling at a time is offered for use. The person needing the paper towel would then grip the portion of the paper towel offered (not shown) and, without touching anything with their hands other than the toweling, pull on it the dispensed portion to separate from the remainder of the toweling on paper towel roll 4. It is contemplated for foot pedal 14 and mechanically operated foot pedal 44 to be positioned so that the foot of an operator (not shown) may easily engage it.

What is claimed is:

1. A dispenser for use in public places for hands-free dispensing of individual portions of a product wrapped about a length of tubing having a longitudinal axis, the product having a continuous length and wherein individual portions of said product are separable from said continuous length by an operator for independent use, said dispenser comprising:

a housing having a hollow interior, an interior surface, a front, a back, and a bottom surface, said hollow interior having sufficient size and dimension to contain a product intended for dispensing that is wrapped about a length of tubing, said bottom surface having a front portion which downwardly and rearwardly slopes away from said front of said housing;

a first means for causing said tubing to rotate about said longitudinal axis, said first means comprising a drive gear and being connected to said tubing, said first means also comprising at least one mounting bracket for supporting said tubing within said housing, said mounting bracket being connected between said tubing and said interior surface of said housing;

a second means for initiating movement of said first means, said second means being positioned outside of said housing in a position for convenient use by an operator's foot, said second means being configured and dimensioned for quick and easy use by an operator's foot, said second means also being configured for release of only one individual portion of said product per engagement of said second means by an operator's foot;

a third means attached to and positioned between said first means and said second means for translating movement of said second means into rotational movement of said drive gear so that when said back of said housing is positioned against a vertical surface and an operator's foot engages said second means, movement of said second means is translated through said third means to said first means and causes said tubing to sufficiently rotate about said longitudinal axis for hand-free dispensing of one individual portion of said product through said opening and beyond said housing for detachment and use by the operator.

2. The dispenser of claim 1 wherein said first means further comprises an electric motor, a control circuit, a length of electrical wire, and an alternating current power supply access cord and plug, said electric motor having a drive shaft and a pinion gear axially connected to said drive shaft, said pinion gear being positioned to engage said drive gear, said electrical wire being connected between said control circuit and said motor, and said power supply access cord being connected between said control circuit and a remote power supply; wherein said second means comprises a depressible foot pedal which when depressed by an operator's foot causes an electrical signal to be sent through said third means to said control circuit; and wherein said third means comprises a length of electrical cord connected through said bottom surface of said housing between said second means and said control circuit.

3. The dispenser of claim 1 wherein said first means further comprises an electric motor, a control circuit, a length of electrical wire, and a direct current power source, said electric motor having a drive shaft and a pinion gear axially connected to said drive shaft, said pinion gear being positioned to engage said drive gear, a first portion of said electrical wire being connected between said control circuit and said motor, a second portion of said electrical wire being connected between said control circuit and said direct current power source; wherein said second means comprises a depressible foot pedal which when depressed by an operator's foot causes an electrical signal to be sent through said third means to said control circuit; and wherein said third means comprises a length of electrical cord connected through said bottom surface of said housing between said second means and said control circuit.

4. The dispenser of claim 1 wherein said first means further comprises a ratchet and a crank, said crank being connected between said third means and said drive gear, said ratchet also engaging said drive gear to limit the speed of rotation of said drive gear during dispensing of said product; wherein said second means comprises a mechanically-operated foot pedal having a depressible portion, a hinge, a base member, and a spring, said spring being positioned between said depressible portion and said base member to bias said depressible portion upwardly from said base member, said hinge being also positioned between said depressible portion and said base member in a position opposed to said spring to maintain attachment of said depressible portion to said base member; and wherein said third means comprises a rigid linkage connected between said depressible portion and said crank.

5. A method for hands-free dispensing in public places of individual portions of a product wrapped about a length of tubing, said method comprising the steps of:

providing a housing, a rigid vertical surface, a product wrapped about a length of tubing, a foot pedal, a foot pedal connector, a drive gear with rotation means, and a mounting bracket;

positioning and securing said housing against said rigid vertical surface;

using said mounting bracket to position said product within said housing so that one individual portion of said product will pass through said opening during dispensing;

attaching said drive gear to said tubing;

connecting one opposite end of said foot pedal connector to said drive gear;

connecting the other opposite end of said foot pedal connector through said housing to said foot pedal; and depressing said foot pedal to cause hands-free dispensing of one individual portion of said product through said housing.

6. The method of claim 5 wherein said step of providing a foot pedal comprises the providing of a mechanically operated foot pedal having a depressible portion, a base member, a spring, and a hinge; wherein said step of providing a foot pedal connector comprises the providing of a rigid linkage, wherein said step of providing a drive gear with rotation means comprises the providing of a crank and ratchet; and further comprising the steps of connecting one end of said base member and one end of said depressible portion with said hinge, connecting said spring between an opposed end of said base member and an opposed end of said depressible portion so as to bias said depressible portion upwardly away from said base member, connecting one of said opposite ends of said linkage to said depressible portion, connecting the other of said opposite ends of said linkage to one end of said crank, connecting the other end of said crank to said drive gear, and positioning said ratchet against said drive gear to prevent reverse rotation of said product.

7. The method of claim 5 wherein said step of providing a foot pedal comprises the providing of an electrically operated foot pedal; wherein said step of providing a foot pedal connector comprises the providing of an electrical cord, wherein said step of providing a drive gear with rotation means comprises the providing of an electrical motor having a drive shaft and a pinion gear axially connected to said drive shaft, a control circuit, a length of electrical wire, and a power supply access cord; and further comprising the steps of connecting one of said opposite ends of said electrical cord to said foot pedal, connecting the other of said opposite ends of said electrical cord to said control circuit, connecting said electrical wire between said control circuit and said motor, and using said power supply access cord to connect said control circuit to a remote alternating current power supply.

8. The method of claim 5 wherein said step of providing a foot pedal comprises the providing of an electrically operated foot pedal; wherein said step of providing a foot pedal connector comprises the providing of an electrical cord, wherein said step of providing a drive gear with rotation means comprises the providing of an electrical motor having a drive shaft and a pinion gear axially connected to said drive shaft, a control circuit, a direct current power source, a length of electrical wire; and further comprising the steps of connecting one of said opposite ends of said electrical cord to said foot pedal, connecting the other of said opposite ends of said electrical cord to said control circuit, connecting a first portion of said electrical wire between said control circuit and said motor, and connecting a second portion of said electrical wire between said control circuit and said direct current power source.

* * * * *